US006712641B2

(12) United States Patent
Beege et al.

(10) Patent No.: US 6,712,641 B2
(45) Date of Patent: Mar. 30, 2004

(54) RESILIENT CONTACT AND ASSEMBLY THEREOF

(75) Inventors: Werner Beege, Hainburg (DE); Werner Radde, Babenhausen (DE)

(73) Assignee: Weidmueller Interface GmbH & Co., Detmold (DE)

( * ) Notice: Subject to any disclaimer, the term of this patent is extended or adjusted under 35 U.S.C. 154(b) by 0 days.

(21) Appl. No.: 10/123,184

(22) Filed: Apr. 17, 2002

(65) Prior Publication Data

US 2002/0155750 A1 Oct. 24, 2002

(30) Foreign Application Priority Data

Apr. 23, 2001 (DE) ..... 201 06 998 U
Oct. 31, 2001 (DE) ..... 201 17 770 U

(51) Int. Cl.[7] ..... H01R 4/24
(52) U.S. Cl. ..... 439/441; 439/835
(58) Field of Search ..... 439/436–441, 439/835, 266, 268

(56) References Cited

U.S. PATENT DOCUMENTS

| | | | | | |
|---|---|---|---|---|---|
| 5,083,936 | A | * | 1/1992 | Yang | 439/441 |
| 5,324,213 | A | * | 6/1994 | Frantz | 439/441 |
| 5,494,456 | A | | 2/1996 | Kozel et al. | |
| 5,685,735 | A | * | 11/1997 | Hohorst | 439/441 |
| 5,915,991 | A | * | 6/1999 | Roman | 439/441 |
| 6,074,242 | A | * | 6/2000 | Stefaniu et al. | 439/441 |
| 6,250,950 | B1 | * | 6/2001 | Pallai | 439/441 |
| 6,261,120 | B1 | * | 7/2001 | Beege et al. | 439/441 |
| 6,270,383 | B1 | | 8/2001 | Wielsch et al. | |
| 6,336,824 | B1 | * | 1/2002 | Sorig | 439/441 |
| 6,350,162 | B1 | | 2/2002 | Despang | |

FOREIGN PATENT DOCUMENTS

| | | |
|---|---|---|
| DE | 1 830 465 U | 5/1961 |
| DE | 1 213 024 B | 9/1961 |
| DE | 1 213 025 C | 3/1963 |
| DE | 1 881 162 U | 10/1963 |
| DE | 1 989 058 U | 7/1968 |
| DE | 1989058 | 7/1968 |
| DE | 1 665 922 A | 2/1971 |
| DE | 2002911 | 7/1971 |
| DE | 2227557 | 12/1973 |
| DE | 2349614 | 4/1975 |
| DE | 77 193 74 U1 | 9/1977 |
| DE | 30 35 886 C2 | 5/1982 |
| DE | 35 20 826 A1 | 12/1986 |
| DE | 3701246 | 7/1988 |
| DE | 295 00 614 U1 | 4/1995 |
| DE | 43 36 965 A1 | 5/1995 |
| DE | 196 14 977 A1 | 10/1996 |
| DE | 299 15 515 U1 | 3/2001 |
| EP | 0458410 | 11/1991 |
| FR | 1 386 072 | 12/1964 |
| JP | 2-172164 A | 9/1990 |
| JP | 5-234624 A | 12/1993 |
| JP | 2001057250 | 2/2001 |

OTHER PUBLICATIONS

Deutsches Patent–und Markenamt; Mar. 12, 2002; Search Report of the German utility model 201 17 770.6.

Deutsches Patent–und Markenamt; Jul. 13, 2001:Search Report of the German utility model 201 06 998.9.

* cited by examiner

*Primary Examiner*—Hien Vu
(74) *Attorney, Agent, or Firm*—Lawrence E. Laubscher, Sr.

(57) ABSTRACT

An electrical terminal adapted for connection with a conductor, comprising a hollow electrically conductive terminal containing a chamber receiving a U-shaped spring, and an opening for receiving a conductor that is biased by one leg of the spring into engagement with a given wall of the terminal chamber, the spring one leg having an operating tab portion that extends through a slot contained in the given terminal wall. A plurality of the terminals may be provided in an outer housing that is formed of an electrically insulating synthetic plastic material.

3 Claims, 10 Drawing Sheets

RESILIENT CONTACT AND ASSEMBLY THEREOF

BACKGROUND OF THE INVENTION

1. Field of the Invention

This invention relates to an electrical terminal that includes a hollow conductive terminal body containing an opening for receiving a conductor, a spring being provided within a chamber defined within the terminal body for biasing the conductor toward electrical engagement with a given wall of the chamber. The spring includes a leg having an operating tab portion that extends externally of the terminal via a slot contained in said given wall, thereby to permit the spring leg to be displaced to a retracted position for the insertion or withdrawal of the conductor from the terminal chamber.

2. Brief Description of the Prior Art

Resilient electrical terminals are well known in the patented prior art, as illustrated, for example, by the prior German patent No. DE 19614977, and the U.S. patents to Wielsch, et al., U.S. Pat. No. 6,270,383 and Despang U.S. Pat. No. 6,350,162, among others. In such terminals, it is known to provide a resilient member that biases a bare conductor into engagement with the conductive terminal wall. In the German patent, a projecting portion of the spring affords means for displacing the legs of the spring toward an open condition for the insertion and removal of the conductor relative to the terminal.

The present invention was developed to provide a spring terminal that can be made at reasonable cost with a particularly simple design that can be connected and disconnected in a simpler manner than the various types of currently available typical spring terminals.

SUMMARY OF THE INVENTION

Accordingly, a primary object of the present invention is to provide a resilient electrical terminal including a hollow conductive terminal body containing an opening communicating with a chamber within the terminal body, and a U-shaped spring mounted in said chamber, said spring having an outwardly biased contact leg for biasing an electrical conductor that is introduced into the chamber via said opening toward electrical engagement with a given wall of the chamber, said contact leg having an operating tab that extends outwardly from the terminal body via a slot contained in the chamber wall. The terminal body and the spring are each formed by bending a strip of metal stock material. Upon operation of the operating tab, the contact leg is displaced from a normal clamping position toward a released position, thereby to permit the conductor to be inserted into, or withdrawn from, the chamber.

Since the resilient terminal assembly requires only a few simple parts each formed from sheet metal, it is easily and inexpensively produced. By simple manipulation of the operating tab externally or the terminal, the spring contact leg may be displaced to the released position for insertion and withdrawal of the conductor from the terminal chamber. Furthermore, a rigid conductor may be merely inserted directly into the terminal chamber by force fit and without any operation of the operating tab.

According to a further object of the invention, a protective synthetic plastic insulating housing may be mounted upon the terminal assembly following its soldering connection with the printed circuit board. Locking foot means may be provided for releasably connecting the protective housing with the terminal assembly and/or the printed circuit board.

According to another embodiment of the invention, two or more springs may be provided within a single terminal body for connecting a plurality of conductors with the terminal body. Each spring includes a leg having an operating tab portion that extends outwardly via an associated slot, respectively. Thus, selective operation of the operating lugs permits insertion and removal of the various conductors, respectively.

According to a further modification, the two legs of a single U-shaped spring may be utilized to bias a pair of conductors toward engagement with opposed walls of the terminal chamber, respectively, each spring leg being provided with an operating tab portion.

Another object of the invention is to provide a terminal block that contains one or more of the terminal assemblies, said terminal block containing first openings that receive the operating tool that engages the operating tab on a spring leg, and second openings through which the conductors are inserted within and removed from the terminal chambers, respectively.

The present invention permits the terminal block assemblies to be soldered to a printed circuit board, and to be subsequently enclosed in a protective housing.

BRIEF DESCRIPTION OF THE DRAWINGS

Other objects and advantages of the invention will become apparent from a study of the following specification when viewed in the light of the accompanying drawings, in which.

DETAILED DESCRIPTION

Figure 1A:
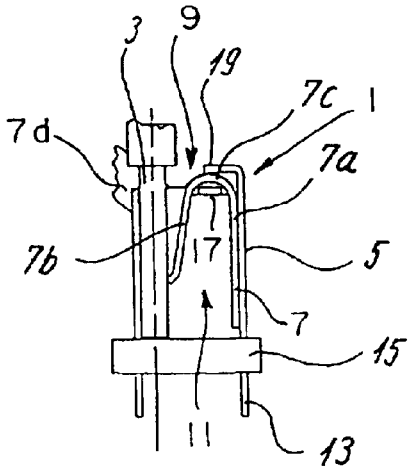
FIGS. 1*a*–1*c* are end elevation, top plan, and side elevation views illustrating as assembly of a plurality of resilient terminals of the present invention mounted on a common printed circuit board.
Figure 1B:
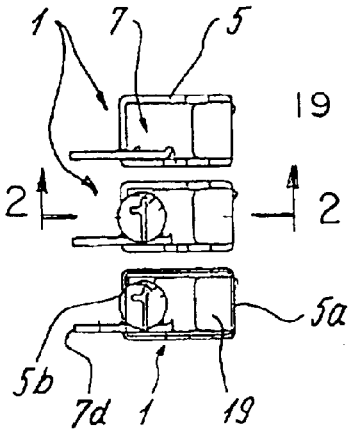
Figure 1C:
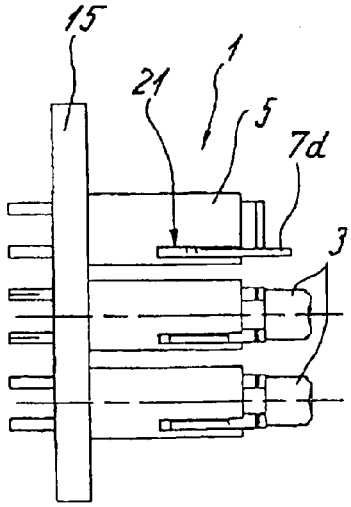
Figure 2:
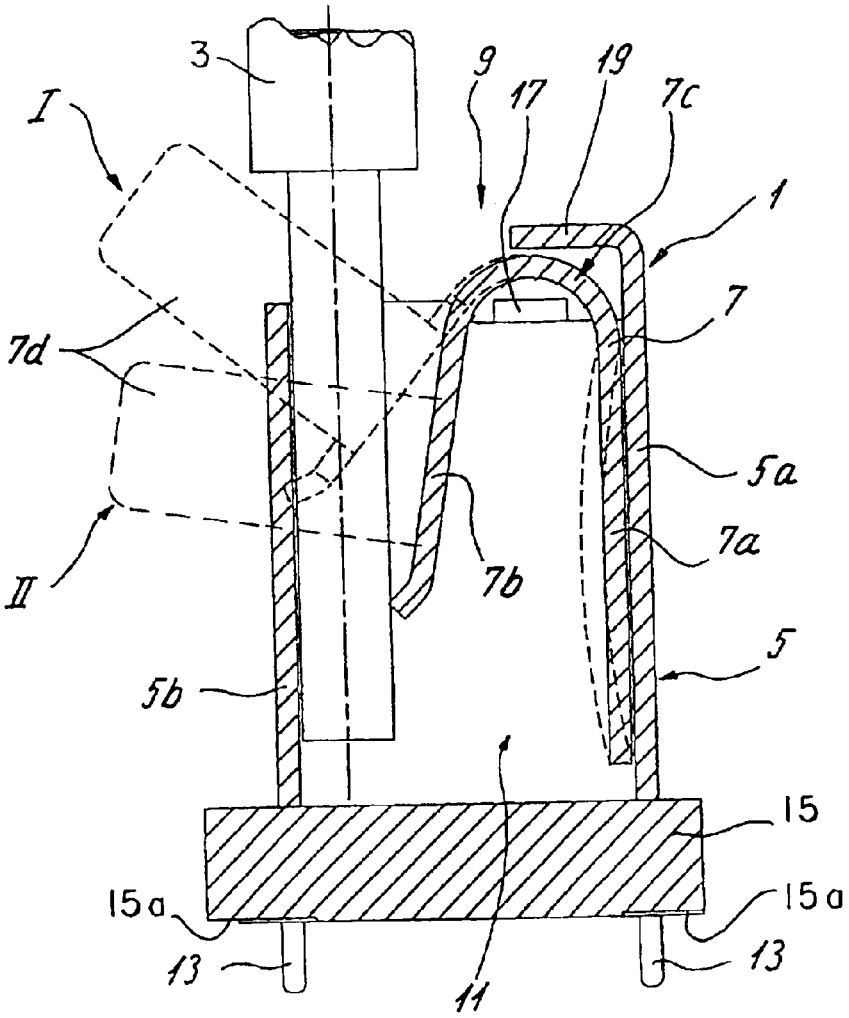
FIG. 2 is a sectional view of the terminal of the present invention taken along line 2—2 of FIG. 1.
Figure 3:
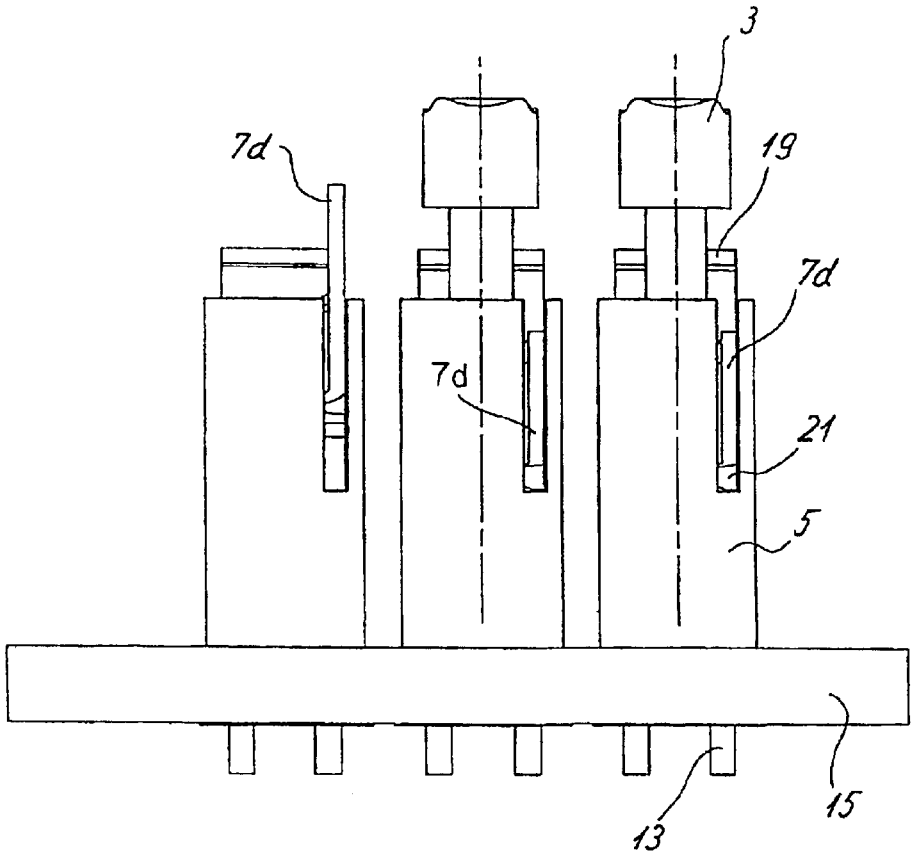
FIG. 3 is an enlarged view of the terminal assembly of FIG. 1*c;*

Referring first more particularly to FIGS. 1–3, the resilient terminal assembly 1 of the present invention includes a hollow terminal body 5 that is formed by bending from a single sheet of a conductive metal, such as copper. The terminal 5 has a rectangular cross sectional configuration and is provided at its upper end with an opening 9 for receiving the bare end of an insulated conductor 3, and an open bottom end 11. Mounted within the chamber defined within the terminal body 5 is a resilient U-shaped spring 7 having a pair of leg portions 7*a* and 7*b* that are joined by a connecting portion 7*c*. As best shown in FIG. 2, the first leg 7*a* is a support leg that engages the inner chamber wall 5*a* of the terminal body 5, and the other leg 7*b* is a contact leg that is resiliently biased outwardly to displace the conductor 4 into electrical engagement with the opposed wall 5*b* of the terminal chamber. In order to retain the spring 7 within the terminal chamber, the terminal body is provided with an integral bent first horizontal support lug 17 that extends beneath the spring connecting portion 7*c*, and an horizontal upper bent lug 19 that extends above the spring connecting portion 7*c*. The terminal body is provided at its lower end with a pair of soldering lugs 13 that extend downwardly through corresponding openings within a printed circuit board 15. The soldering lugs 13 may be soldered to printed circuits 15*a* that are provided on the adjacent lower surface of the printed circuit board 15.

In accordance with a characterizing feature of the present invention, the second spring leg portion 7*b* that biases the conductor 3 against the terminal body wall 5*b* includes an orthogonally bent operating tab portion 7*d*. This tab portion extends outwardly from the terminal via slots 21 provided in the second terminal wall 5*b*, as best shown in FIGS. 2 and 3.

The spring leg portion 7*b* is normally biased outwardly toward the extended position I illustrated in phantom toward the second wall 5*b* of the terminal. When the operating tab portion 7*d* is displaced downwardly, the leg portion 7*b* is displaced toward the support leg 7*a*, thereby to permit the conductor 3 to be inserted within or withdrawn from the terminal chamber via the opening 9 contained in the upper end of the terminal. As shown in FIG. 2, when the conductor 3 is inserted into the terminal chamber, upon release of the operating tab portion 7*d*, the leg portion 7*b* is resiliently displaced outwardly to the position II to bias the conductor 3 into electricacl engagement with the conductive wall 5*b* of the terminal.

The operating tab portion 7*d* is integral with and extends orthogonally from the spring leg 7*b*. The spring 7 is formed by bending from a single metal strip formed from a suitable resilient material, such as spring steel. The operating tab portion 7*d* extends outwardly of the terminal via the slot 21 contained in the terminal wall 5*b*, as shown in FIGS. 1*c* and 3.

Figure 4:
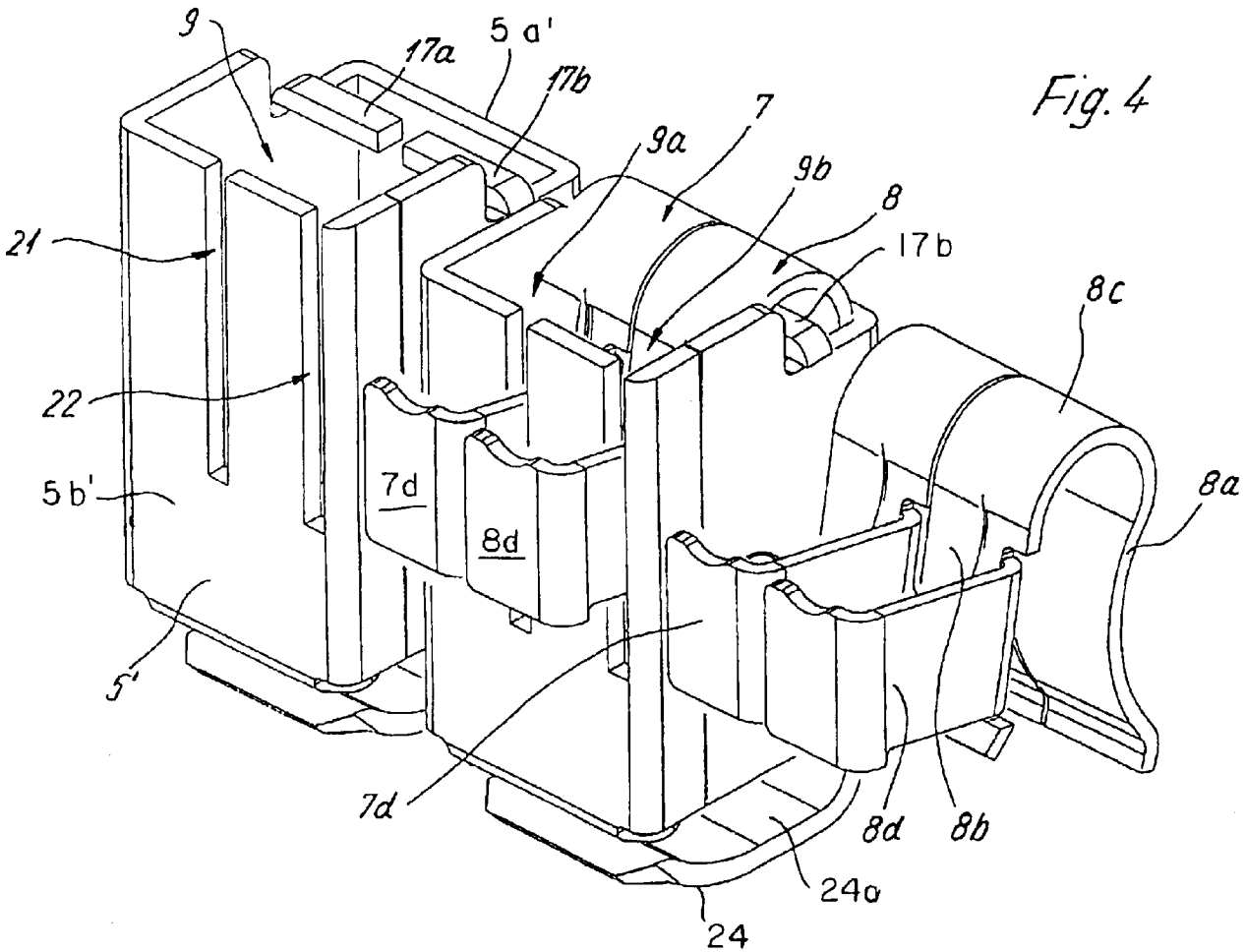
FIG. 4 is a perspective view of a multi-contact terminal with certain parts disassembled for explanatory purposes.
Figure 5:
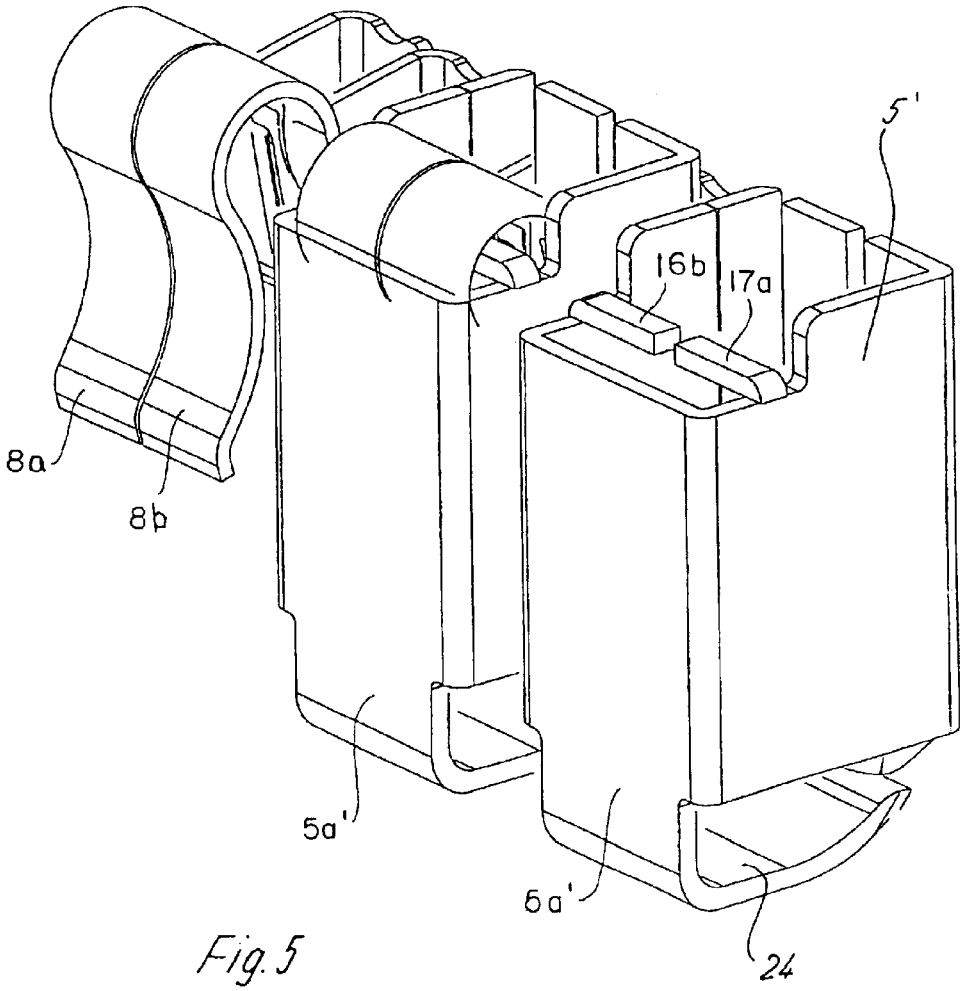
FIG. 5 is a rear perspective view of the multi-contact assembly of FIG. 4.
Figure 6:
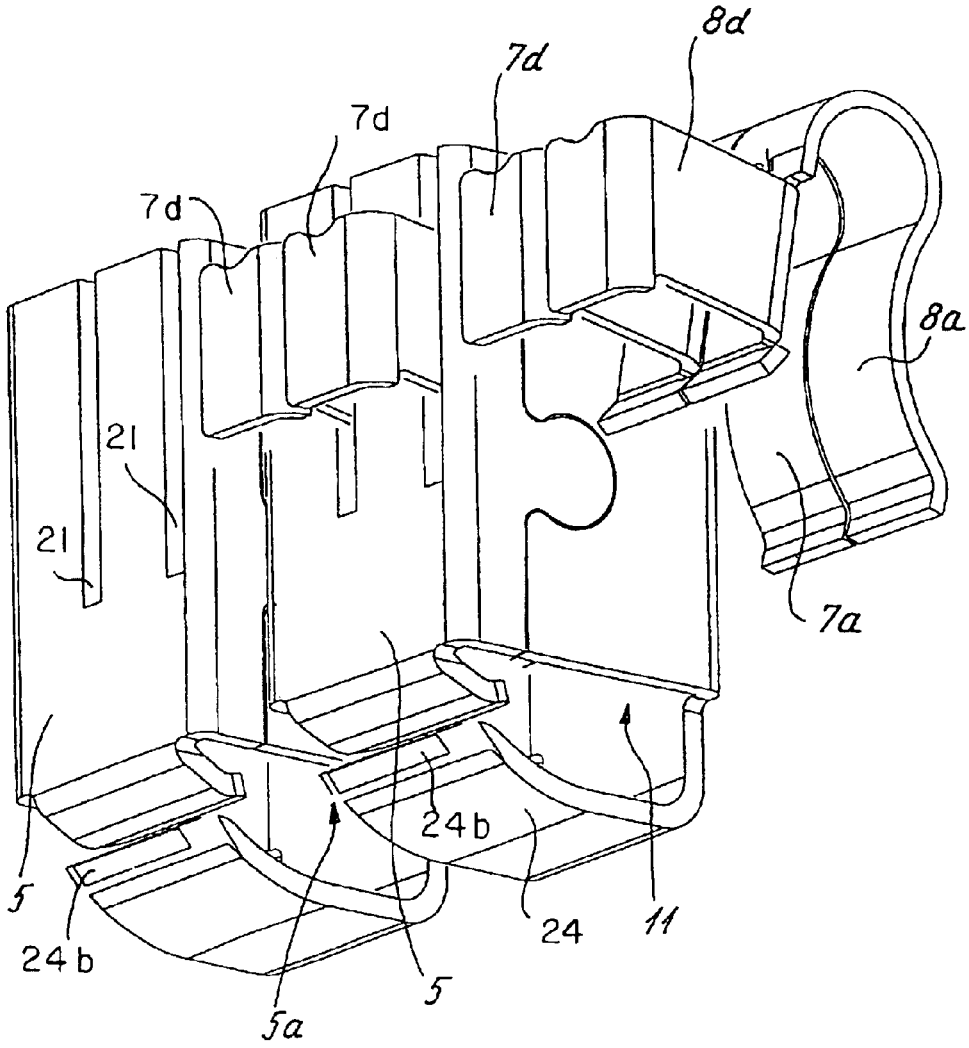
FIG. 6 is a bottom perspective view of the assembly of FIG. 4.

Referring now to the modification shown in FIGS. 4–6, a pair of U-shaped springs 7 and 8 are provided in the terminal body 5', said springs having first and second leg portions 7*a*, 7*b* and 8*a*, 8*b* that are connected by connecting portions 7*a*, 8*c*, respectively. Operating tab portions 7*d*, 8*d* extend orthogonally from the second leg portions 7*b*, 8*b*, respectively, outwardly of the terminal body via a pair of slots 21 contained in the terminal second wall 5*b*'. In this embodiment, a bottom bent portion 24 extends from the first terminal wall horizontally across the bottom opening 11 of the terminal body, thereby to serve as a stop limiting the downward travel of a pair of conductors inserted within the terminal chamber via the top opening 9 of the terminal. A pair of inwardly bent horizontal tabs 17*a*, 17*b* extend from the upper end of the terminal side walls beneath the connecting portion 7*c*, 8*c* of the springs 7 and 8, respectively. The bottom stop portion 24 of the terminals may be provided with slots or openings 24*b* that permit the insertion of a vertical bus bar S between the spring and the first terminal wall 5*a*, as will be shown in FIG. 8.

While two springs 7 and 8 have been illustrated as being mounted within the terminal body, it is apparent that a greater number of springs may be provided for use with a greater number of conductors, if desired.

Figure 7:
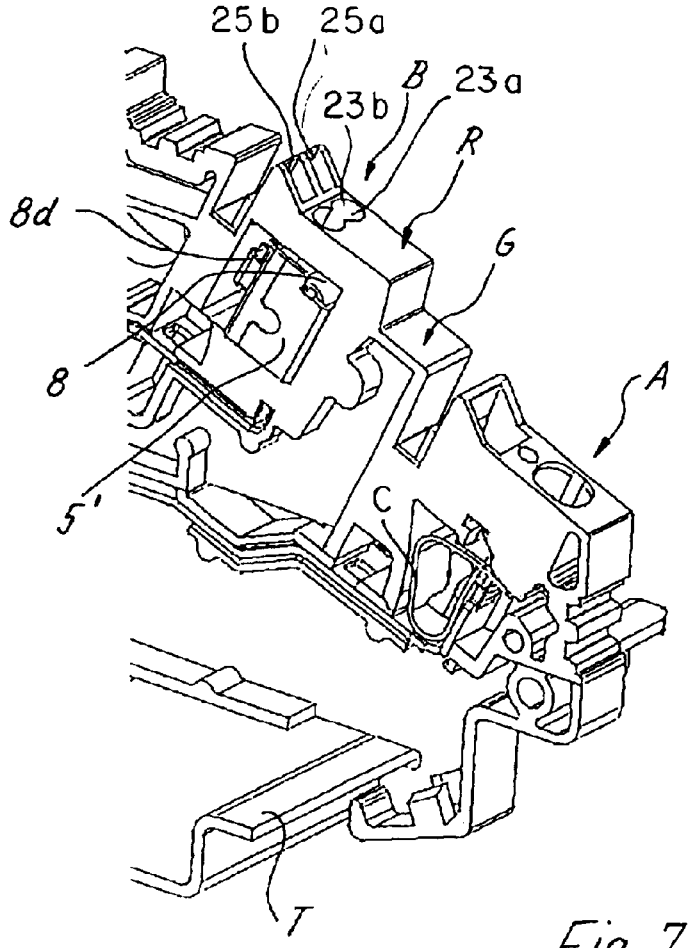
FIG. 7 illustrates the manner of mounting an electrical terminal of the present invention within a terminal block that is adapted for mounting on a support rail.

Referring now to FIG. 7, the terminal assembly 5 of the present invention may be mounted within a terminal block R having an insulating housing that is adapted for connection with a generally U-shaped supporting rail T, as is known in the art. The terminal block includes a lower tier A that contains a resilient connector C of the prior art, and a second tier B that contains the terminal arrangement 5' of FIGS. 4–6. Thus, the terminal assembly 5' contains a pair of springs 7 and 8 only one of which (i.e., spring 8) is shown in FIG. 7. The terminal block R contains a pair of first operating openings for receiving a tool (such as a screwdriver) that engages the operating tabs 7*d* or 8*d* to manually displace the associated spring leg to the retracted position, and a pair of conductor openings 23*a*, 23*b* for the insertion and removal of a pair of conductors relative to the terminal chamber, whereby upon removal of the tool from the opening 25*a* or 25*b*, the associated spring leg returns toward its extended position to bias the conductor into electrical contact with the terminal wall.

Figure 8:
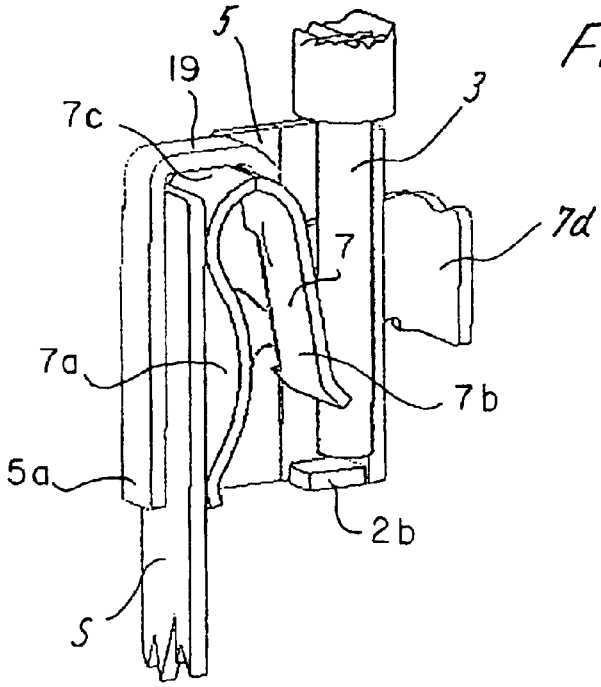
FIG. 8 is a modification of the invention provided with a bus bar.

Referring now to FIG. 8, in accordance with the present invention, it is possible to introduce a bus bar S between the first spring leg 7*a* and the first wall 5*a* of the terminal body 5. Thus, in this embodiment, the spring leg 7*b* biases the conductor 3 against the terminal wall 5*b*, and the spring leg 7*a* biases the bus bar S into electrical engagement with the terminal wall 5*a*. Stop projections 26 are bent to horizontal positions at the bottom of the terminal body.

Figure 9:
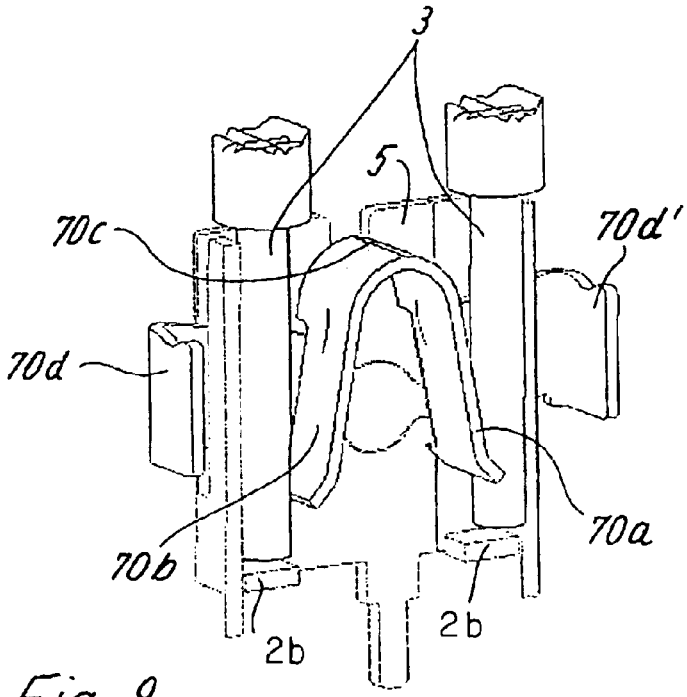
FIG. 9 is a modification of the invention where the spring member is operable to bias two conductors inserted within a single terminal.

Referring now to FIG. 9, the spring 70 has a pair of legs 70*a* and 70*b* that are connected by the upper connecting portion 70*c*. The legs are provided with orthogonally-extending operating tab portions 70*d* and 70*d*' that extend outwardly of the terminal body via the side walls slots 21. Consequently, a single spring may be used to connect a pair of conductors 3 to the terminal body 5.

Figure 10:
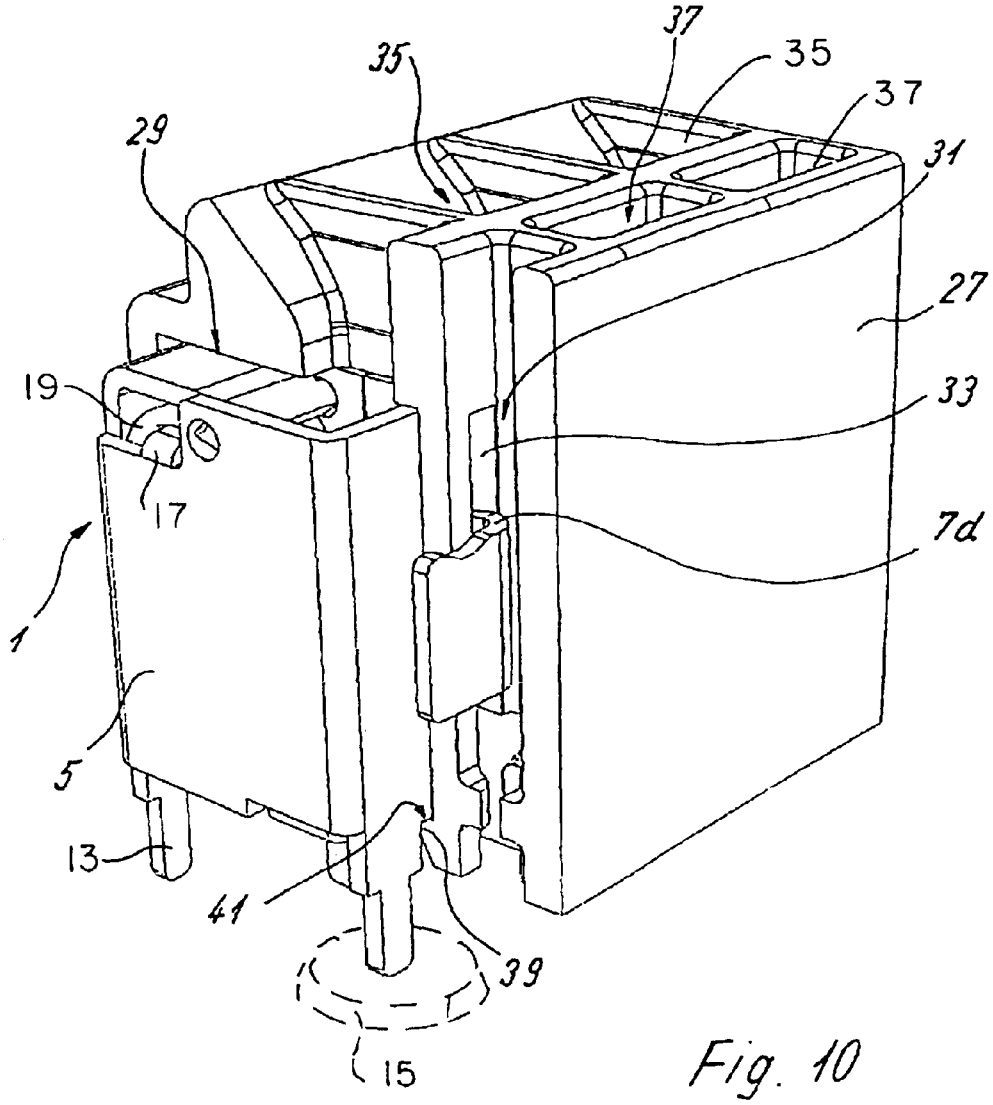
FIG. 10 is a front perspective view of a terminal assembly that is mounted within an insulating housing.
Figure 11:
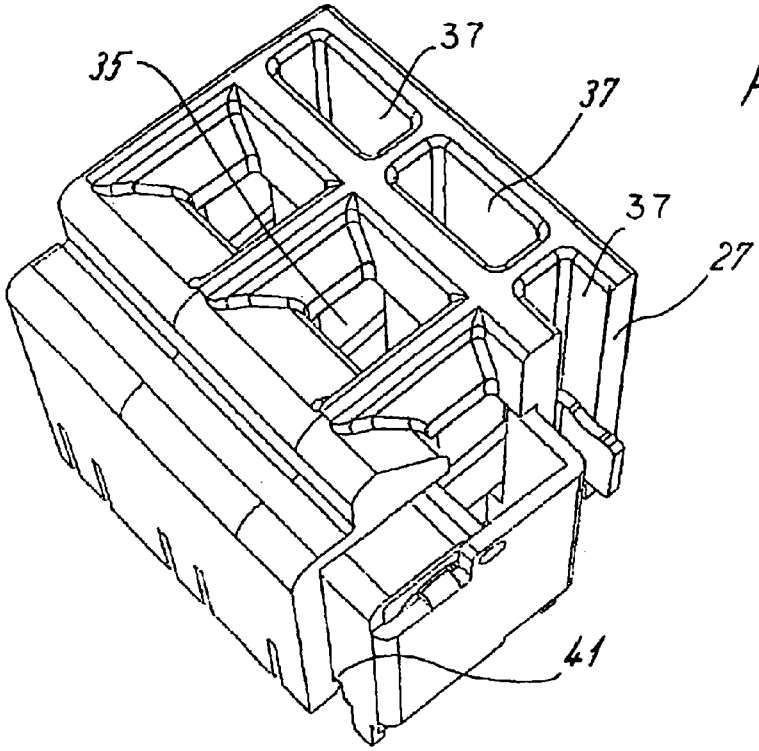
FIGS. 11 and 12 are top perspective and bottom perspective views respectively of the assembly of FIG. 10.
Figure 12:
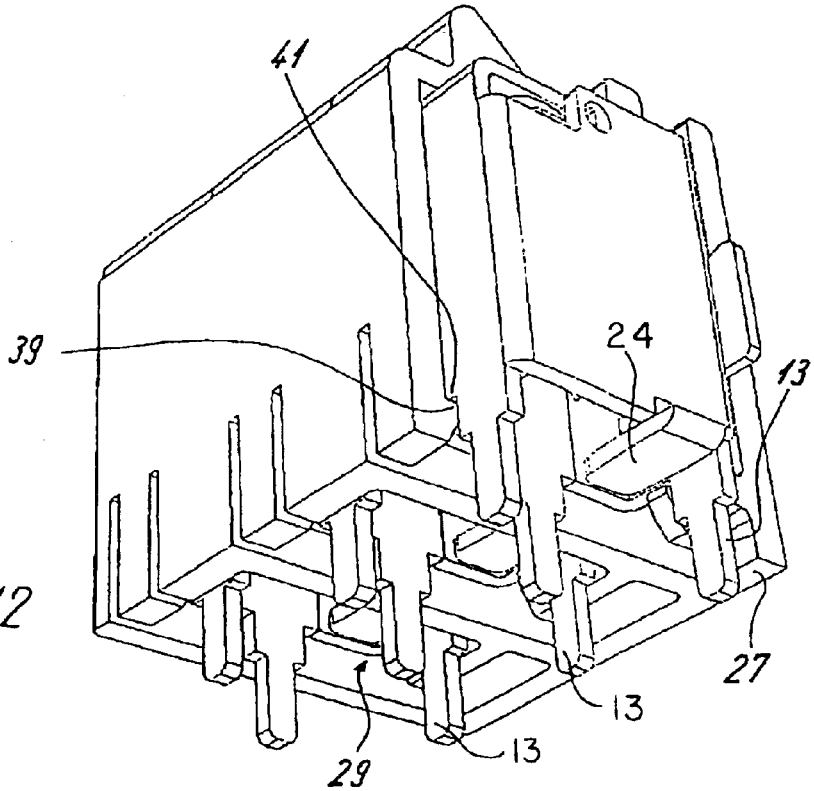

Referring to FIGS. 10–12, the terminal block assembly of FIG. 3 may be provided with an outer insulating housing 27, that is formed of a suitable synthetic plastic insulating material. The outer housing 27 contains tool openings 37 for inserting tools such as a screwdriver to engage the operating tab 7*d* of the various terminal assemblies, as well as second openings 35 which permit conductors to be inserted within or withdrawn from the chambers contained within the various terminals 5. The operating tab 7*d* extend outwardly via slots 33 contained in the outer housing 27. Locking mean such as catch hooks 39 may be provided which snap under the edge 41 of the terminal block assembly, thereby to fasten the insulating housing to the terminal block assembly. Soldering lugs 13 may be provided for soldering the assembly to the printed circuit board 15, in the manner illustrated in FIG. 2, for example.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. An electrical terminal adapted for electrical connection with the end of a conductor, comprising:

(a) a conductive metal terminal (5) containing a chamber having a pair of opposed walls (5*a*; 5*b*), said terminal also containing a first opening (9) for receiving one end of a conductor (3) within said chamber;

(b) a resilient generally U-shaped spring (7) arranged within said terminal chamber, said spring including a pair of leg portions (7*a*; 7*b*) that are connected by a connecting portion (7*c*), said spring connecting portion being arranged adjacent said terminal first opening, a first one of said spring legs (7*a*) being arranged adjacent a first one (5*a*) of said terminal walls, and the second of said legs (7*b*) being resiliently biased outwardly toward a normal extended position adjacent an opposite second one (5*b*) of said terminal walls, whereby when the conductor end is inserted into the terminal chamber via said first opening, said second spring leg biases the conductor into engagement with said second terminal wall;

(c) said terminal and said spring each being unitary and formed from a sheet metal strip;

(d) said second spring leg including an orthogonally arranged operating tab portion (7*d*) that extends away from said first spring leg outwardly through a slot (21) contained in said terminal second wall, said second spring leg being operable by means of said operating tab from said extended position toward a retracted position adjacent said first spring leg, thereby to permit alternate insertion and removal of the conductor relative to said terminal chamber; and (e) an outer housing (27) removably mounted concentrically about said terminal, said outer housing being formed of synthetic plastic electrical insulating material and containing:

(1) a plurality of first chambers (29) containing a plurality of said terminals, respectively;

(2) a plurality of slots (33) receiving the operating tab portions (7*d*) of said springs, respectively; and (3) a plurality of first openings (35) opposite the spring second legs for the introduction of the ends of conductors into said first chambers, respectively; and (4) a plurality of second openings (37) opposite said slots and said spring operating tab portions, respectively, thereby to permit the introduction of an operating tool for engagement with the operating tab of a selected one of said springs, respectively.

2. An electrical terminal adapted for electrical connection with the end of a conductor, comprising:

(a) a conductive metal terminal (5) containing a chamber having a pair of opposed walls (5*a*; 5*b*), said terminal also containing a first opening (9) for receiving one end of a conductor (3) within said chamber;

(b) a resilient generally U-shaped spring (7) arranged within said terminal chamber, said spring including a pair of leg portions (7*a*; 7*b*) that are connected by a connecting portion (7*c*), said spring connecting portion being arranged adjacent said terminal first opening, a first one of said spring legs (7*a*) being arranged adjacent a first one (5*a*) of said terminal walls, and the second of said legs (7*b*) being resiliently biased outwardly toward a normal extended position adjacent an opposite second one (5*b*) of said terminal walls, whereby when the conductor end is inserted into the terminal chamber via said first opening, said second spring leg biases the conductor into engagement with said second terminal wall;

(c) said terminal and said spring each being unitary and formed from a sheet metal strip;

(d) said second spring leg including an orthogonally arranged operating tab portion (7*d*) that extends away from said first spring leg outwardly through a slot (21) contained in said terminal second wall, said second spring leg being operable by means of said operating tab from said extended position toward a retracted position adjacent said first spring leg, thereby to permit alternate insertion and removal of the conductor relative to said terminal chamber; and (e) an outer housing (27) removably mounted concentrically about said terminal, said outer housing being formed of synthetic plastic electrical insulating material and containing:

(1) a plurality of first chambers (29) containing a plurality of said terminals, respectively;

(2) a plurality of slots (33) receiving the operating tab portions (7*d*) of said springs, respectively; and (3) a plurality of first openings (35) opposite the spring second legs for the introduction of the ends of conductors into said first chambers, respectively; and (f) attachment means for connecting said terminals with said outer housing, said attachment means including a plurality of catch hooks (39) provided on the lower edge portion of said outer housing for engagement with corresponding lower edge portions of said terminals, respectively.

3. An electrical terminal is defined in claim 1, wherein each of said terminals includes at its lower end a horizontal stop lug (24) that limits the extent of insertion of the conductor into said terminal chamber.

* * * * *